US009123285B2

(12) United States Patent
Ko

(10) Patent No.: US 9,123,285 B2
(45) Date of Patent: Sep. 1, 2015

(54) TRANSPARENT DISPLAY DEVICE AND TRANSPARENCY ADJUSTMENT METHOD THEREOF

(71) Applicant: Acer Incorporated, New Taipei (TW)

(72) Inventor: Chueh-Pin Ko, New Taipei (TW)

(73) Assignee: Acer Incorporated, New Taipei (TW)

( * ) Notice: Subject to any disclaimer, the term of this patent is extended or adjusted under 35 U.S.C. 154(b) by 240 days.

(21) Appl. No.: 13/802,777

(22) Filed: Mar. 14, 2013

(65) Prior Publication Data

US 2013/0314433 A1 Nov. 28, 2013

(30) Foreign Application Priority Data

May 28, 2012 (TW) ..... 101118960 A

(51) Int. Cl.

| | |
|---|---|
| ***G09G 3/20*** | (2006.01) |
| ***G09G 5/30*** | (2006.01) |
| ***G09G 5/02*** | (2006.01) |

(52) U.S. Cl.

CPC .. *G09G 5/30* (2013.01); *G09G 3/20* (2013.01); *G09G 5/026* (2013.01); *G09G 2320/0686* (2013.01); *G09G 2360/144* (2013.01)

(58) Field of Classification Search

CPC ..... G09G 3/20; G09G 5/30
USPC ..... 345/592
See application file for complete search history.

(56) References Cited

U.S. PATENT DOCUMENTS

| | | | | |
|---|---|---|---|---|
| 6,559,813 | B1 * | 5/2003 | DeLuca et al. | 345/8 |
| 6,864,927 | B1 | 3/2005 | Cathey | |
| 6,940,545 | B1 * | 9/2005 | Ray et al. | 348/222.1 |
| 6,996,783 | B2 * | 2/2006 | Brown et al. | 715/790 |
| 2003/0142132 | A1 | 7/2003 | Brown et al. | |
| 2005/0043933 | A1 * | 2/2005 | Rappaport et al. | 703/1 |
| 2006/0239524 | A1 * | 10/2006 | Desh et al. | 382/128 |
| 2007/0083825 | A1 * | 4/2007 | Chaudhri et al. | 715/788 |
| 2009/0279737 | A1 * | 11/2009 | Strens | 382/103 |
| 2009/0298547 | A1 * | 12/2009 | Kim et al. | 455/566 |
| 2011/0084893 | A1 * | 4/2011 | Lee et al. | 345/6 |
| 2012/0105428 | A1 * | 5/2012 | Fleck et al. | 345/419 |
| 2012/0163021 | A1 * | 6/2012 | Bohn et al. | 362/608 |

FOREIGN PATENT DOCUMENTS

| | | |
|---|---|---|
| EP | 2372513 | 10/2011 |
| JP | S602985 | 1/1985 |
| KR | 100774928 | 11/2007 |
| TW | 200905535 | 2/2009 |
| TW | 201133329 | 10/2011 |

* cited by examiner

*Primary Examiner* — Devona Faulk
*Assistant Examiner* — Hai Tao Sun
(74) *Attorney, Agent, or Firm* — Jianq Chyun IP Office

(57) ABSTRACT

A transparent display device and a transparency adjustment method thereof are provided. The transparent display device includes a transparent display unit, a sensing module and a processing unit. The sensing module detects at least one of conditions of the environmental background of the transparent display device and a user's input. The processing unit determines if it is necessary to adjust the transparent degree of a transparent image displayed by the transparent display unit or not according to a sensing result detected by the sensing module.

12 Claims, 8 Drawing Sheets

TRANSPARENT DISPLAY DEVICE AND TRANSPARENCY ADJUSTMENT METHOD THEREOF

CROSS-REFERENCE TO RELATED APPLICATION

This application claims the priority benefit of Taiwan application serial no. 101118960, filed on May 28, 2012. The entirety of the above-mentioned patent application is hereby incorporated by reference herein and made a part of this specification.

BACKGROUND OF THE INVENTION

1. Field of the Invention

The invention relates to a transparent display device. More particularly, the invention relates to a transparent display device capable of adjusting transparency and a transparency adjustment method of the transparent display device.

2. Description of Related Art

At present, the performance requirements of the market for liquid crystal displays (LCD) include high contrast ratio, no gray scale inversion, little color shift, high luminance, high color vividness, high color saturation, quick response, wide-viewing angle, and so forth.

The LCDs can normally be categorized into a transmissive LCD, a reflective LCD, and a transflective LCD. Since the application of displays is rather extensive, transparent displays have been gradually developed. The transparent display has a sufficient transparency rate, which enables a person to look through the display panel and observe the background behind the panel. Besides, the transparent display has a wide range of use in a variety of areas, e.g., the transparent display may be applied to windows of buildings or cars or may be used in showcase events. Since the transparent display not only can perform the inherent transparent display function but also may serve as an information display in the future, the transparent display has attracted great attention of the market.

On account of the properties of transparency, the transparent display may be utilized in different manner in comparison with the conventional non-transparent display. However, the transparency properties may lead to certain issues. For instance, the background behind the transparent display may impair the quality of images displayed on the transparent display. Moreover, the overly intense ambient light or the complicated background color or lines may confuse a viewer who watches an image on the transparent display. Thereby, the display quality of the transparent display is significantly reduced.

SUMMARY OF THE INVENTION

The invention is directed to a transparent display device and its transparency adjustment method capable of adjusting transparency of a display image according to an environmental background, so as to significantly improve display quality of the transparent display device.

In an embodiment of the invention, a transparent display device that includes a transparent display unit, a sensing module, and a processing unit is provided. The transparent display unit displays a transparent image frame according to a display data signal. The sensing module is configured on the transparent display unit. Here, the sensing module senses one of conditions of an environmental background of the transparent display device and a user's input and accordingly outputs a sensing signal. The processing unit is coupled to the transparent display unit and the sensing module and controls the transparent display unit to adjust transparency of the transparent image frame according to the sensing signal.

According to an embodiment of the invention, the sensing module includes a photo-sensing unit sensing light intensity of the environmental background and accordingly outputting the sensing signal. When the light intensity exceeds a threshold value, the processing unit controls the transparent display unit to reduce the transparency of the transparent image frame according to the sensing signal.

According to an embodiment of the invention, the processing unit further determines a transparency adjustment parameter corresponding to the light intensity according to the sensing signal and outputs the transparency adjustment parameter to the transparent display unit, so as to control the transparent display unit to reduce the transparency of the transparent image frame.

According to an embodiment of the invention, the sensing module includes a photographing unit capturing an ambient image of the environmental background as the sensing signal. The processing unit calculates at least one of the light intensity and a clutter degree of the ambient image of the environmental background according to the sensing signal, determines a transparency adjustment parameter corresponding to the light intensity or the clutter degree according to at least one of the light intensity and the clutter degree, and outputs the transparency adjustment parameter to the transparent display unit, so as to control the transparent display unit to adjust the transparency of the transparent image frame.

According to an embodiment of the invention, when the light intensity or the clutter degree of the ambient image of the environmental background exceeds a corresponding threshold value or corresponds to a corresponding predetermined range, the processing unit controls the transparent display unit to reduce transparency of an image region corresponding to the ambient image whose light intensity or clutter degree exceeds the corresponding threshold value or corresponds to the corresponding predetermined range, and the image region is in the transparent image frame.

According to an embodiment of the invention, the sensing module includes a touch unit sensing a touch action of a user and outputting the sensing signal. The processing unit determines a transparency adjustment parameter of an image region correspondingly touched by the user according to the sensing signal and outputs the transparency adjustment parameter to the transparent display unit, so as to adjust transparency of the image region touched by the user.

According to an embodiment of the invention, the processing unit further adjusts transparency of an image object corresponding to an application program in the transparent image frame according to the application program.

In an embodiment of the invention, a transparency adjustment method of a transparent display device is provided. The transparency adjustment method includes following steps. At least one of conditions of an environmental background of the transparent display device and a user's input is sensed, and a sensing signal is accordingly output. Transparency of a transparent image frame of the transparent display device is adjusted according to the sensing signal.

According to an embodiment of the invention, the condition of the environmental background includes a light intensity of the environmental background, and the step of adjusting the transparency of the transparent image frame according to the sensing signal includes following steps. Whether the light intensity of the environmental background exceeds a threshold value is determined. If the light intensity of the environmental background exceeds the threshold value, a transparent adjustment parameter corresponding to the light intensity is determined according to the sensing signal. The transparency of the transparent image frame is reduced according to the transparent adjustment parameter.

According to an embodiment of the invention, the condition of the environmental background includes a light intensity and a clutter degree of an ambient image of the environmental background, and the step of adjusting the transparency of the transparent image frame according to the sensing signal includes following steps. The light intensity and the clutter degree of the ambient image of the environmental background are calculated according to the sensing signal. Whether the light intensity or the clutter degree of the ambient image of the environmental background exceeds a corresponding threshold value or corresponds to a corresponding predetermined range is determined. If the light intensity or the clutter degree of the ambient image of the environmental background exceeds the corresponding threshold value or corresponds to the corresponding predetermined range, a transparent adjustment parameter corresponding to the light intensity or the clutter degree is determined according to the sensing signal. The transparency of an image region corresponding to the ambient image whose light intensity or clutter degree exceeds the corresponding threshold value or corresponds to the corresponding predetermined range is reduced according to the transparent adjustment parameter, and the image region is in the transparent image frame.

According to an embodiment of the invention, the user's input is a touch action of the user, and the step of adjusting the transparency of the transparent image frame according to the sensing signal includes following steps. A transparency adjustment parameter of an image region corresponding to the touch action of the user is found out according to the sensing signal. Transparency of the image region corresponding to the touch action of the user is reduced according to the transparency adjustment parameter.

In view of the above, the conditions of the user's input and the environment where the transparent display device is located are sensed by the sensing module, and the processing unit determines whether to adjust the transparency of all or several regions of the transparent image frame according to the sensing result detected by the sensing module, so as to prevent the deterioration of the display quality of the transparent display device due to the environmental background.

In order to make the aforementioned and other features and advantages of the invention more comprehensible, embodiments accompanying figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1:
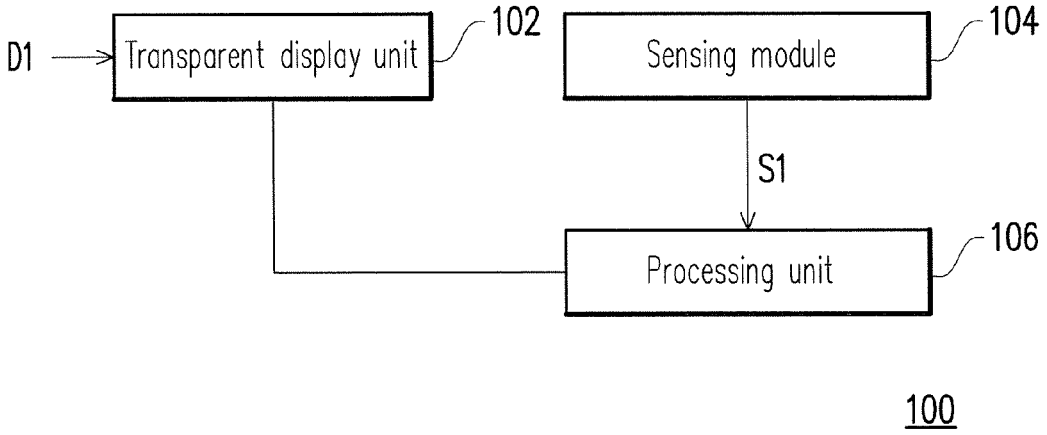
FIG. 1 is a schematic diagram illustrating a transparent display device according to an embodiment of the invention.

FIG. 1 is a schematic diagram illustrating a transparent display device according to an embodiment of the invention. With reference to FIG. 1, the transparent display device 100 includes a transparent display unit 102, a sensing module 104, and a processing unit 106. The sensing module 104 is configured on the transparent display unit 102, and the processing unit 106 is coupled to the transparent display unit 102 and the sensing module 104. The transparent display unit 102 may be characterized by transparency, such as a liquid crystal display (LCD) panel or an organic light-emitting diode (OLED) display panel, for instance, and the transparent display unit 102 displays a transparent image frame according to a display data signal D1.

The sensing module 104 is applied to sense one of conditions of a user's input and environment where the transparent display device 100 is located, and the sensing module 104 accordingly outputs a sensing signal S1. The environmental condition may refer to the profile lines or the color block distribution of the environment where the transparent display device 100 is located; the user's input may include an input action of the user with use of a keyboard, a mouse, or a touch panel, for instance. The processing unit 106 serves to control the transparent display unit 102 to adjust transparency of the transparent image frame displayed on the transparent display unit 102 according to the sensing signal S1. As described above, the transparent display unit 102 may be an LCD panel or an OLED display panel. In different embodiments of the transparent display unit 102, the way to adjust the transparency of the transparent image frame is changed.

For instance, the transparent display unit 102 is assumed to be the LCD panel. In order for the image frame displayed on the transparent display unit 102 not to be disturbed by the background behind the transparent display unit 102, the luminous flux passing through the transparent display unit 102 may be reduced by adjusting the gray scale level of pixels, such as reducing contrast, reducing gain, reducing brightness, or adjusting a gamma curve. Thereby, the transparency can be reduced. From another perspective, the transparent display unit 102 is assumed to be the OLED panel. In order for the brightness of the transparent display image to exceed the light intensity of the environment where the transparent display device 100 is located, the gain and the brightness may be enhanced, the gamma curve may be adjusted, or the light intensity of display pixels may be increased. Thereby, the transparency can be reduced.

Besides, in other embodiments, the transparent display unit 102 may be formed by applying the existing transparent display technology, and the transparent display unit 102 may be the LCD panel or the OLED panel that is overlapped with a transparency control board. Here, partial or entire transparency may be directly controlled by the transparency control board.

Note that the transparency adjustment of the transparent image frame described in an embodiment of the invention is not limited to adjustment of the entire frame, and it is likely to adjust the transparency of partial frame, such that the transparent display device 100 may comply with actual application requirements. Through adjustment of conditions of the user's input and the environment where the transparent display device 100 is located, the transparency of all or several regions of the transparent image frame may be adjusted, and hence the display quality of the transparent display device 100 is not negatively affected by the environmental background.

Figure 2:
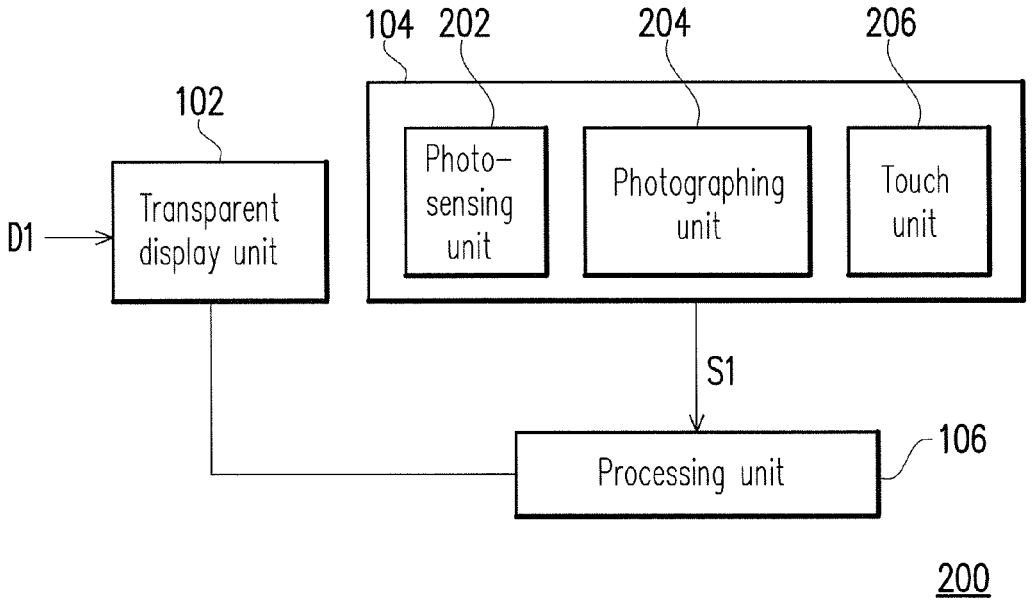
FIG. 2 is a schematic diagram illustrating a transparent display device according to another embodiment of the invention.

FIG. 2 is a schematic diagram illustrating a transparent display device according to another embodiment of the invention. Specifically, the sensing module 104 of the transparent display device 200 may include a photo-sensing unit 202, a photographing unit 204, and a touch unit 206. Note that the sensing module 104 in other embodiments of the invention may merely include one of or two of the photo-sensing unit 202, the photographing unit 204, and the touch unit 206. The photo-sensing unit 202 senses the light intensity of the environmental background of the transparent display device 200 and thereby outputs the sensing signal S1. When the light intensity exceeds a threshold value, the processing unit 106 determines a transparency adjustment parameter corresponding to the light intensity according to the sensing signal S1 and outputs the transparency adjustment parameter to the transparent display unit 102, so as to control the transparent display unit 102 to reduce the transparency of the transparent image frame. The threshold value of the light intensity may be varied in different photo-sensing units 202. For instance, the threshold value may be set as ISO 1000, 300 lux, or 3.2 V of a sensing voltage, for instance.

Figure 3A:
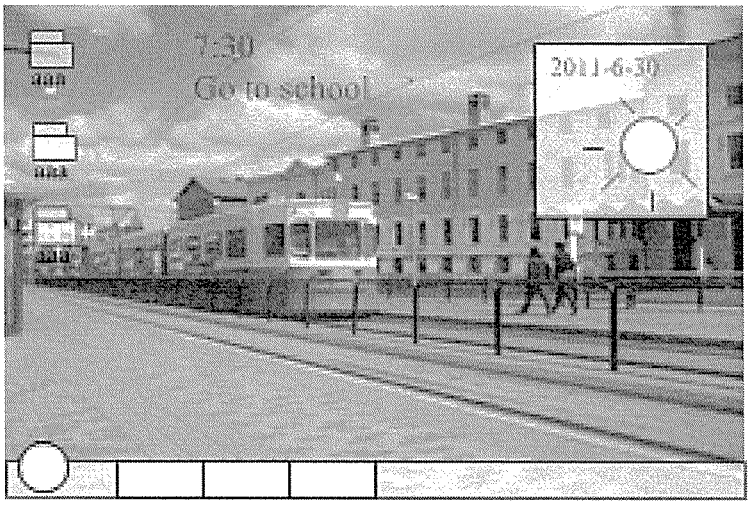
FIG. 3A to FIG. 3D' are schematic diagrams illustrating adjustment of transparency of a transparent image frame according to an embodiment of the invention.
Figure 3A:
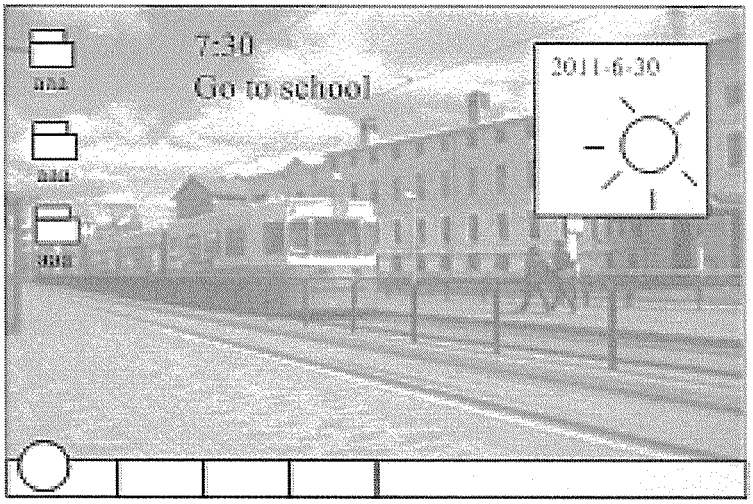

FIG. 3A and FIG. 3A' are schematic diagrams exemplarily illustrating adjustment of transparency of a transparent image frame according to an embodiment of the invention. Here, FIG. 3A shows the transparent image frame before adjustment of transparency, while FIG. 3A' shows the transparent image frame after adjustment of transparency. As indicated in FIG. 3A and FIG. 3A', the image object interfered by the background becomes more visible after the transparency of the transparent image frame is reduced as a whole. For instance, after the transparency of the transparent image frame is reduced as a whole, the reminder texts "7:30 Go to school" shown in FIG. 3A and FIG. 3A' become more legible.

The photographing unit 204 serves to capture the ambient image of the environmental background of the transparent display device 200 as the sensing signal S1, and the processing unit 106 calculates at least one of the light intensity and the clutter degree of the ambient image according to the sensing signal S1 and controls the transparent display unit 102 to adjust the transparency of the transparent image frame according to at least one of the light intensity and the clutter degree of the ambient image. When the light intensity or the clutter degree of the ambient image exceeds the corresponding threshold value or corresponds to a corresponding predetermined range, the processing unit 106 determines a transparency adjustment parameter of the corresponding light intensity or the corresponding clutter degree according to the sensing signal S1 and outputs the transparency adjustment parameter to the transparent display unit 102, so as to reduce the transparency of an image region corresponding to the ambient image whose light intensity or clutter degree exceeds the corresponding threshold value or corresponds to the corresponding predetermined range, and the image region is in the transparent image frame.

The threshold value of the light intensity may be determined by an average gray scale level of the ambient image (i.e., the sensing signal S1), and the average gray scale level may be calculated with every 1600 display pixels as one unit, for instance. With a range of 256 gray scale levels, if the average gray scale level exceeds 180, the transparency of the image region is determined to be reduced. From another perspective, the threshold value of the clutter degree may be determined by the image variation frequency of an image object in the ambient image, e.g., every 30 display pixels as one unit. If the image variation frequency of an image object exceeds 10 B-W cycle, the transparency of the image region is determined to be reduced. Note that the transparency herein may be determined by analyzing the image variation frequency or the frequency distribution of all or parts of the image regions in the background. The analysis may be done by detecting the edge of the background image and converting the same into a gray-scale image. Certain gray scale difference (e.g., greater than 100 levels) is analyzed and deemed as a B-W cycle, and the frequency of each position is analyzed based on the number and density of the cycles, so as to subsequently adjust the transparency. The configuration of said threshold values is merely exemplary and should not be construed as a limitation to the invention.

Figure 3B:
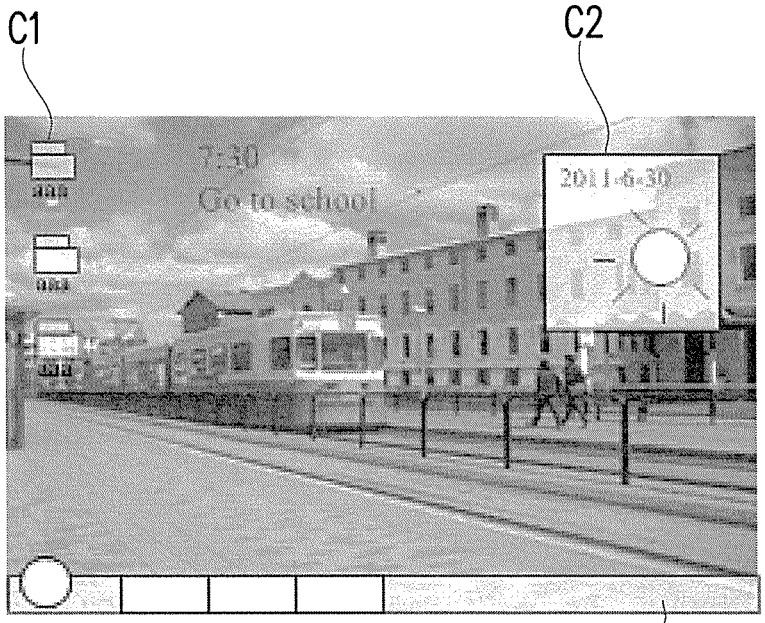
Figure 3B:
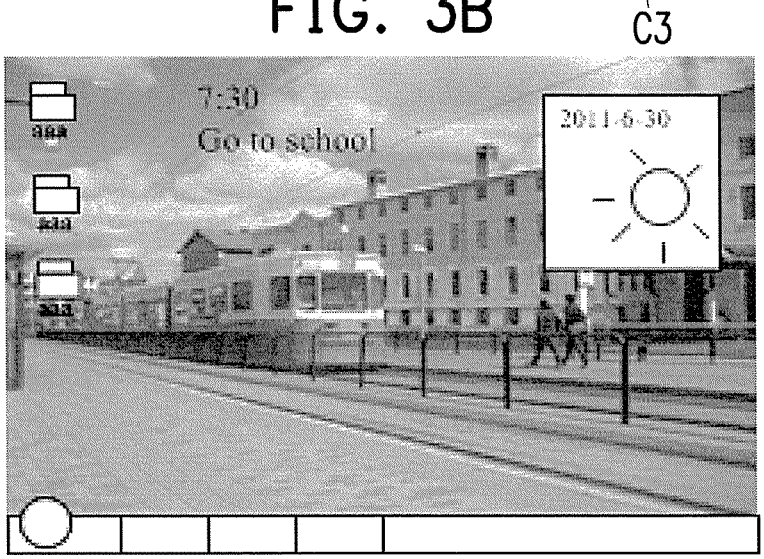
Figure 3C:
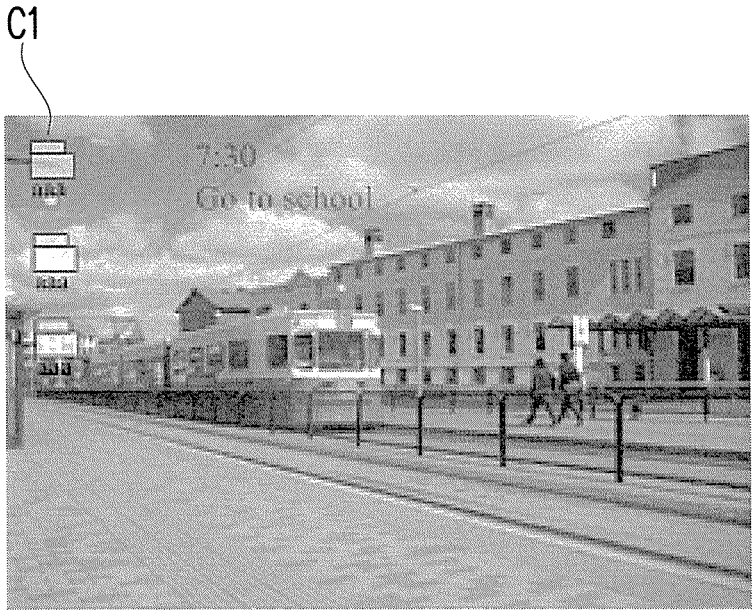
Figure 3C:
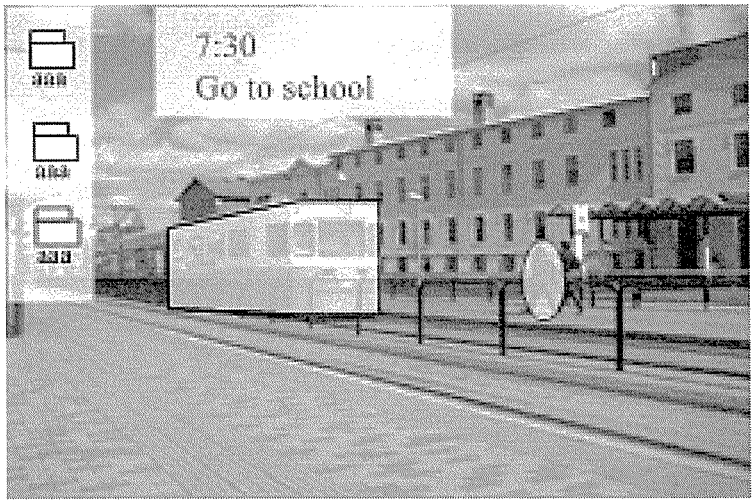
Figure 3D:
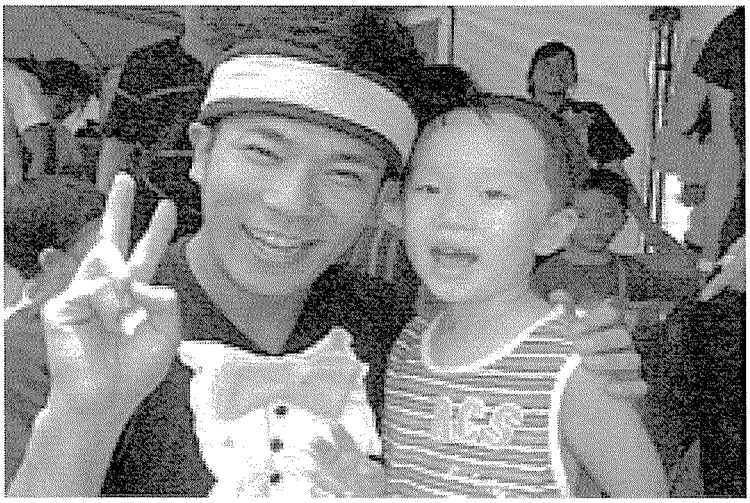
Figure 3D:
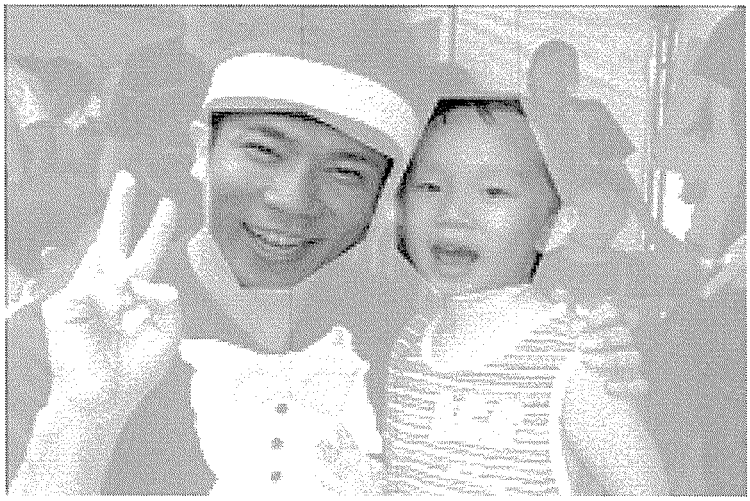

The adjustment of transparency of several image regions in the transparent image frame may expand the application scope of the transparent display device 200. FIG. 3B to FIG. 3D and FIG. 3B' to FIG. 3D' are schematic diagrams exemplarily illustrating adjustment of transparency of a transparent image frame according to an embodiment of the invention. Here, FIG. 3B to FIG. 3D show the transparent image frame before adjustment of transparency, while FIG. 3B' to FIG. 3D' show the transparent image frame after adjustment of transparency. With reference to FIG. 3B and FIG. 3B', the desktop icon C1, the display window C2 on the desktop, and the toolbar C3 shown in FIG. 3B are affected by the environmental background and are not clearly shown prior to transparency adjustment. After the adjustment of transparency, the image contents of the desktop icon C1, the display window C2 on the desktop, and the toolbar C3 can be clearly displayed, and the user is not precluded from observing the background scenery through the transparent display device 200. Thereby, the user may compare the information of environmental background obtained online with the information of environmental background observed through the transparent display device 200, which facilitates the use of the transparent display device 200.

For instance, when a user observes the solar eclipse, the transparent display device 100 may be placed between the sun and eyes of the user, and the photo-sensing unit 200 may sense that the sun is a highly intense light source and merely adjust the gray scale level at the image region corresponding to the sun. Thereby, the transparency can be reduced, and the user is allowed to easily view the solar eclipse through the transparent display device 202.

In an embodiment of the invention, the processing unit 106 may directly adjust the transparency of an image object corresponding to an application program in the transparent image frame according to the application program. For instance, the desktop icon C1, the display window C2 on the desktop, and the toolbar C3 shown in FIG. 3B may be directly configured to have low transparency. The image objects corresponding to the application programs are not limited to have the same transparency; namely, the image objects, if corresponding to different application programs, may be configured to have different transparencies. For instance, the transparency of the desktop icon C1 may be set as 50%, and the transparency of the display window C2 on the desktop and that of the toolbar C3 may be set as 0%. Note that the image object not only includes the desktop icon, the display window, and the toolbar described above but also comprises a graphic user interface (GUI), certain application programs (e.g., word, photo viewer, and widget) or certain image files (in a doc, jpg, avi, or mpeg format). Besides, each image object may be set to have different transparencies. When various types of image objects are overlapped, the transparencies of these image objects may be different, such that a user is allowed to identify individual image objects.

In addition, the processing unit 106 may directly set up the transparency of certain image region in the transparency image frame, as shown in FIGS. 3C and 3C'. Through the reduction of the transparency of the region around the desktop icon C1 and the reminder texts "7:30 Go to school", the image contents of the desktop icon C1 and the reminder texts "7:30 Go to school" may be easily recognized without being disturbed by the environmental background. As shown in FIG. 3C', the processing unit 106 may reduce the transparency of an image region corresponding to certain background scenery (e.g., the streetcar and people shown in FIG. 3C') in the transparent image frame, so that the user may selectively watch the scenery objects in the environmental background.

Besides, the processing unit 106 may directly compare and analyze the ambient image of the transparent display device 204 captured by the photographing unit 200 and then display the relevant information according to the comparison and analysis. For instance, when a user goes shopping at a supermarket, information (e.g., ingredients) regarding a product (e.g., beverage) behind the transparent display device 200 may be described through augmented reality (AR), given that the transparent display device 200 is applied to a mobile electronic device, e.g., a cell phone or a tablet PC. The processing unit 106 may first compare and analyze the product, so as to learn the brand, the ingredients, the price, or other information of the product, and the processing unit 106 may analyze whether the light intensity or the clutter degree of the environmental background interferes with the display of the descriptions. If the light intensity or the clutter degree of the environmental background indeed interferes with the display of the descriptions, the transparency of the transparent display frame outside the image region occupied by the product is reduced, and the relevant info nation of the product is displayed on the region with the reduced transparency. Thereby, the user is able to watch the relevant information of the product. Here, the clutter degree may serve as a ground for recognition of certain features, such as human face features, object features, or high frequency distribution features.

When a user, for instance, takes pictures with use of a mobile electronic device having the transparent display device 200, the processing unit 106 may recognize human faces on images captured by pressing the shutter of the mobile electronic device, so as to reduce the transparency of regions outside the human face image region. As shown in FIG. 3D and FIG. 3D', the user can thereby edit the information of the human beings displayed in the image regions with the reduced transparency. Note that the human face recognition may be applied on certain users or other human beings.

As shown in FIG. 2, the touch action of a user is sensed, and thereby the sensing signal S1 is output. The processing unit 106 finds out the transparency adjustment parameter of an image region corresponding to the touch action of the user and outputs the transparency adjustment parameter to the transparent display unit 102, so as to reduce the transparency of the touch image region. For instance, the transparency of the desktop icon C1 shown in FIG. 3B is initially assumed to be 50%; when a user clicks on the desktop icon C1, the touch unit 206 senses the user's click action and thereby outputs the sensing signal S1. The processing unit 106, according to the sensing signal S1, finds out the position of the clicked desktop icon C1 and thereby determines the transparency adjustment parameter. The transparency adjustment parameter is then output to the transparent display unit 102 to reduce the transparency of the clicked desktop icon C1. By changing the transparency of the touched image region in response to the touch action of the user, the user is apt to verify the effect of his or her touch action. In another embodiment of the invention, visual feedback of the touch action may be represented by circular ripples or circles on the GUI. Besides, the transparency may be correspondingly adjusted in response to cursor movement or other similar action.

Note that the sensing module 104 of the transparent display device 200 described in the embodiment as shown in FIG. 2 includes the photo-sensing unit 202, the photographing unit 204, and the touch unit 206, while the sensing module 104 may further include other input tools (e.g., press buttons, keyboards, or mice) when it is actually applied. In an embodiment of the invention, the sensing module 104 may merely include one or two of the photo-sensing unit 202, the photographing unit 204, and the touch unit 206.

Figure 4A:
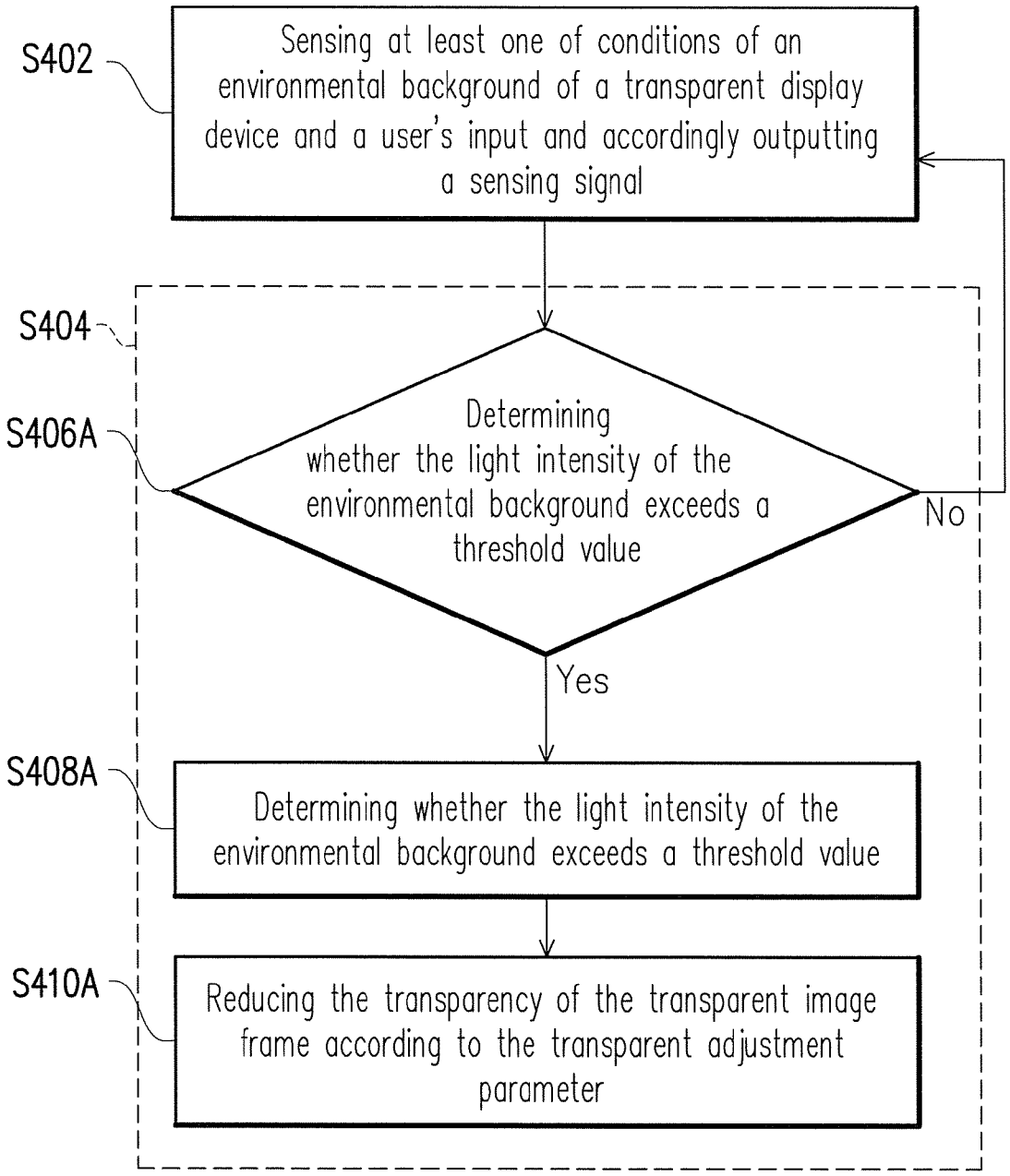
FIG. 4A to FIG. 4C illustrate a transparency adjustment method of a transparent display device according to an embodiment of the invention.

FIG. 4A illustrates a transparency adjustment method of a transparent display device according to an embodiment of the invention. With reference to FIG. 4A, the transparency adjustment method of the aforesaid transparent display device may include following steps. At least one of conditions of an environmental background of the transparent display device and a user's input is sensed, and a sensing signal is accordingly output (step S402). The environmental condition may refer to the light intensity and the clutter degree (e.g., the profile lines or the color block distribution) of the environment where the transparent display device is located; the user's input may include an input action of the user with use of a keyboard, a mouse, or a touch panel, for instance. In step S404, transparency of a transparent image frame of the transparent display device is adjusted according to the sensing signal. In different embodiments of the sensing module 104, the step S404 may include different sub-steps. In the present embodiment, the sensing module 104 is the photo-sensing unit, i.e., the condition of the environmental background refers to the light intensity of the environmental background. Hence, the step S404 may include following sub-steps. Whether the light intensity of the environmental background exceeds a threshold value is determined (step S406A). The threshold value of the light intensity may be varied in different photo-sensing units 202. For instance, the threshold value may be set as ISO 1000, 300 lux, or 3.2 V of a sensing voltage, for instance. If the light intensity of the environmental background does not exceed a threshold value, then return to the step S402. If the light intensity of the environmental background exceeds the threshold value, a transparent adjustment parameter corresponding to the light intensity is determined according to the sensing signal (step S408A). The transparency of the transparent image frame is then reduced according to the transparent adjustment parameter (step S410A).

Figure 4B:
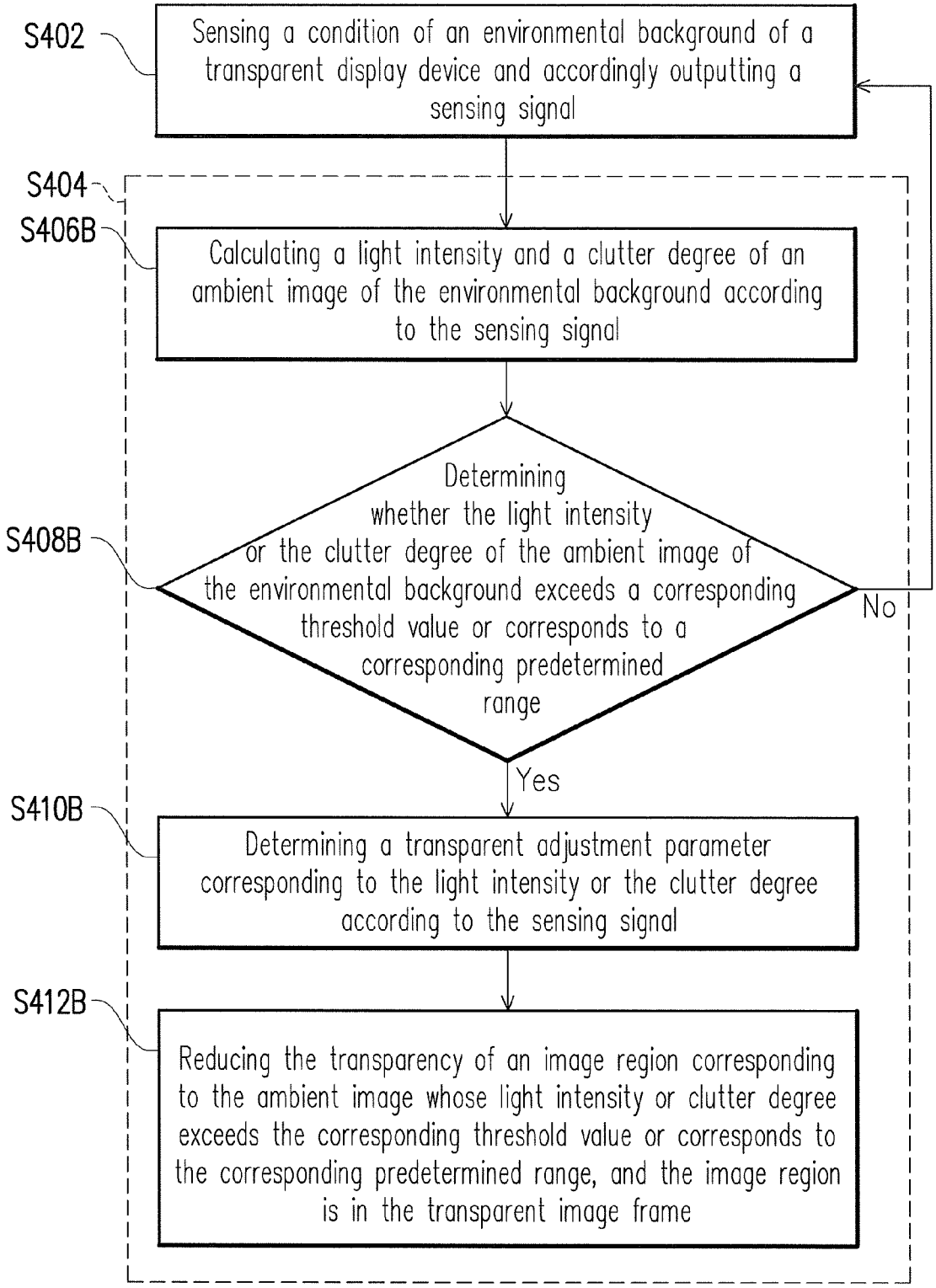

FIG. 4B illustrates a transparency adjustment method of a transparent display device according to an embodiment of the invention With reference to FIG. 4B, the sensing module 104 is the photographing unit, i.e., the condition of the environmental background refers to the light intensity and the clutter degree of the environmental background. Hence, the step S404 may include following sub-steps. The light intensity and the clutter degree of the ambient image of the environmental background are calculated according to the sensing signal (step S406B). The threshold value of the light intensity may be determined by the average gray scale value of display pixels, for instance; the threshold value of the clutter degree may be determined by the image variation frequency of an image object in the ambient image of the environmental background, for instance. Whether the light intensity or the clutter degree of the ambient image of the environmental background exceeds a corresponding threshold value or corresponds to a corresponding predetermined range is determined (step S408B). If neither the light intensity nor the clutter degree of the ambient image of the environmental background exceeds the corresponding threshold value or corresponds to the corresponding predetermined range, then return to the step S402. If the light intensity or the clutter degree of the ambient image of the environmental background exceeds the corresponding threshold value or corresponds to the corresponding predetermined range, a transparent adjustment parameter corresponding to the light intensity or the clutter degree is determined according to the sensing signal (step S410B). The transparency of an image region corresponding to the ambient image whose light intensity or clutter degree exceeds the corresponding threshold value or corresponds to the corresponding predetermined range is reduced according to the transparent adjustment parameter, and the image region is in the transparent image frame (step S412B).

Figure 4C:
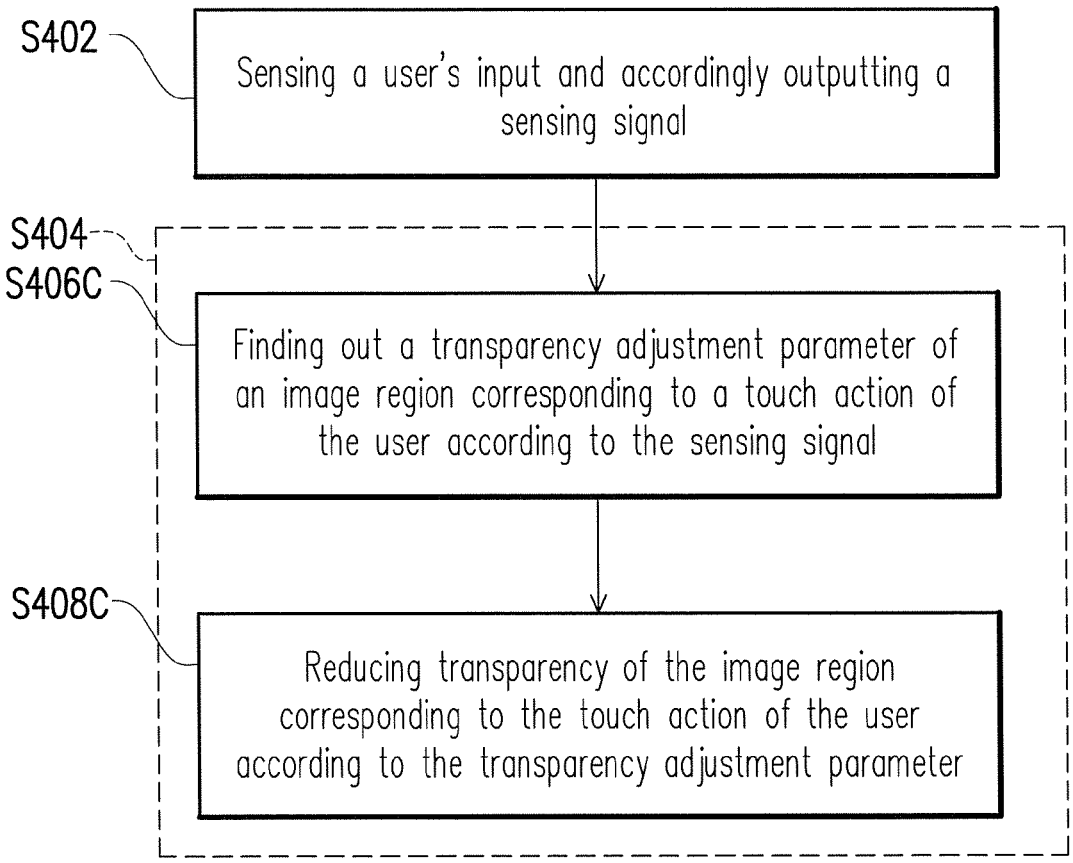

FIG. 4C illustrates a transparency adjustment method of a transparent display device according to an embodiment of the invention. With reference to FIG. 4C, the sensing module 104 is the touch unit, i.e., the user's input refers to the touch action of the user. Hence, the step S404 may include following sub-steps. A transparency adjustment parameter of an image region corresponding to the touch action of the user is found out according to the sensing signal (step S406C). Transparency of the image region corresponding to the touch action of the user is reduced according to the transparency adjustment parameter (step S408C). Some reference embodiments are provided hereinafter.

Here, the transparent display device is assumed to be a transparent LCD panel in an office. Since ample light is often kept in the office work area, a user is able to observe the object behind the transparent display. Through the photo-sensor, the transparent LCD panel detects the light intensity exceeds 300 lux, and thus the transparency reduction mechanism is activated by raising the dim level. As such, the user is no longer or barely able to watch the object behind the display.

In another embodiment, if a user presses a confirmation button on the touch interface of a cell phone according to normal systematic procedures, the GUI (excluding the button region) becomes visually non-transparent in response to the user's action.

In another embodiment, when a user places a tablet PC between the sun and his or her eyes, the photographing unit observes the highly intense light source (i.e., the sun) and thus merely adjusts the gray scale level at the region corresponding to the sun, so as to reduce the transparency in part.

In another embodiment, when a user touches an icon on the GUI of a touch screen, the transparent display device learns the selection of the icon through the touch action, and thereby the transparent display device reduces the transparency of the region corresponding to the icon and relatively raises the transparencies of other image regions. After fingers of the user are moved away from the screen, the transparency setup returns to its original state, and the program corresponding to the touched icon is executed.

In another embodiment, each region touched by a user's fingers correspondingly has high transparency, and therefore transparent holes may gradually appear on the GUI. The transparent holes may then gradually disappear.

To sum up, the conditions of the user's input and the enviromnent where the transparent display device is located are sensed by the sensing module, and the processing unit determines whether to adjust the transparency of all or several regions of the transparent image frame according to the sensing result detected by the sensing module, so as to prevent the deterioration of the display quality of the transparent display device due to the environmental background. Moreover, the processing unit described in an embodiment of the invention may further compare and analyze the environmental background and then display the relevant information according to the comparison and analysis, which significantly facilitates the use of the transparent display device.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A transparent display device comprising:

a transparent display unit displaying a transparent image frame according to a display data signal;

a sensing module configured on the transparent display unit, the sensing module sensing conditions of an environmental background of the transparent display device and accordingly outputting a sensing signal, wherein the sensing module comprises:

a photographing unit capturing an ambient image of the environmental background as the sensing signal; and a processing unit coupled to the transparent display unit and the sensing module, the processing unit controlling the transparent display unit to adjust transparency of the transparent image frame according to the sensing signal, the processing unit calculating a clutter degree of the ambient image according to the sensing signal, determining a transparency adjustment parameter corresponding to the clutter degree according to the clutter degree, and outputting the transparency adjustment parameter to the transparent display unit, so as to control the transparent display unit to adjust the transparency of the transparent image frame.

2. The transparent display device as recited in claim 1, wherein the sensing module comprises:

a photo-sensing unit sensing light intensity of the environmental background and accordingly outputting the sensing signal, wherein when the light intensity exceeds a threshold value, the processing unit controls the transparent display unit to reduce the transparency of the transparent image frame according to the sensing signal.

3. The transparent display device as recited in claim 2, wherein the processing unit further determines a transparency adjustment parameter corresponding to the light intensity according to the sensing signal and outputs the transparency adjustment parameter to the transparent display unit to control the transparent display unit to reduce the transparency of the transparent image frame.

4. The transparent display device as recited in claim 1, wherein the the processing unit further calculating a light intensity of the ambient image according to the sensing signal, determining a transparency adjustment parameter corresponding to the light intensity according to the light intensity, and outputting the transparency adjustment parameter to the transparent display unit, so as to control the transparent display unit to adjust the transparency of the transparent image frame.

5. The transparent display device as recited in claim 4, wherein when the light intensity or the clutter degree of the ambient image exceeds a corresponding threshold value or corresponds to a corresponding predetermined range, the processing unit controls the transparent display unit to reduce transparency of an image region corresponding to the ambient image whose light intensity or clutter degree exceeds the corresponding threshold value or corresponds to the corresponding predetermined range, and the image region is in the transparent image frame.

6. The transparent display device as recited in claim 4, wherein the processing unit further recognizes a human face on an image captured by the photographing unit and reduces transparency of image regions not occupied by the human face.

7. The transparent display device as recited in claim 1, wherein the sensing module comprises:

a touch unit sensing a touch action of a user and outputting the sensing signal, the processing unit determining a transparency adjustment parameter of an image region correspondingly touched by the user according to the sensing signal and outputting the transparency adjustment parameter to the transparent display unit, so as to reduce transparency of the image region touched by the user.

8. The transparent display device as recited in claim 1, wherein the processing unit further adjusts transparency of an image object corresponding to an application program in the transparent image frame according to the application program.

9. A transparency adjustment method of a transparent display device, comprising:

sensing conditions of an environmental background of the transparent display device and accordingly outputting a sensing signal, wherein the condition of the environmental background comprises a clutter degree of an ambient image of the environmental background, and the step of adjusting the transparency of the transparent image frame according to the sensing signal comprises:

calculating the clutter degree of the ambient image of the environmental background according to the sensing signal; and determining whether the clutter degree of the ambient image of the environmental background exceeds a corresponding threshold value or corresponds to a corresponding predetermined range;

if the clutter degree of the ambient image of the environmental background exceeds the corresponding threshold value or corresponds to the corresponding predetermined range, determining a transparent adjustment parameter corresponding to the clutter degree according to the sensing signal; and reducing transparency of an image region corresponding to the ambient image whose clutter degree exceeds the corresponding threshold value or corresponds to the corresponding predetermined range according to the transparent adjustment parameter, and the image region is in the transparent image frame; and adjusting transparency of a transparent image frame of the transparent display device according to the sensing signal.

10. The transparency adjustment method of the transparent display device as recited in claim 9, wherein the condition of the environmental background comprises a light intensity of the environmental background, and the step of adjusting the transparency of the transparent image frame according to the sensing signal comprises:

determining whether the light intensity of the environmental background exceeds a threshold value;

if the light intensity of the environmental background exceeds the threshold value, determining a transparent adjustment parameter corresponding to the light intensity according to the sensing signal; and reducing the transparency of the transparent image frame according to the transparent adjustment parameter.

11. The transparency adjustment method of the transparent display device as recited in claim 9, wherein the condition of the environmental background further comprises a light intensity of an ambient image of the environmental background, and the step of adjusting the transparency of the transparent image frame according to the sensing signal comprises:

calculating the light intensity of the ambient image of the environmental background according to the sensing signal; and determining whether the light intensity of the ambient image of the environmental background exceeds a corresponding threshold value or corresponds to a corresponding predetermined range;

if the light intensity of the ambient image of the environmental background exceeds the corresponding threshold value or corresponds to the corresponding predetermined range, determining a transparent adjustment parameter corresponding to the light intensity according to the sensing signal; and reducing transparency of an image region corresponding to the ambient image whose light intensity exceeds the corresponding threshold value or corresponds to the corresponding predetermined range according to the transparent adjustment parameter, and the image region is in the transparent image frame.

12. The transparency adjustment method of the transparent display device as recited in claim 9, wherein the user's input is a touch action of the user, and the step of adjusting the transparency of the transparent image frame according to the sensing signal comprises:

finding out a transparency adjustment parameter of an image region corresponding to the touch action of the user according to the sensing signal; and reducing transparency of the image region corresponding to the touch action of the user according to the transparency adjustment parameter.

* * * * *